US006830506B2

(12) United States Patent
Catalfamo

(10) Patent No.: US 6,830,506 B2
(45) Date of Patent: Dec. 14, 2004

(54) SURFACE PROCESSING ABRASIVE BODY, SUPPORT PROVIDED WITH SAID BODY AND MACHINE COMPRISING THE PROCESSING ABRASIVE BODY AND SUPPORT

(76) Inventor: Giuseppe Catalfamo, 9, Via Campo dei Fiori, I-21022 Brunello (IT)

( * ) Notice: Subject to any disclaimer, the term of this patent is extended or adjusted under 35 U.S.C. 154(b) by 0 days.

(21) Appl. No.: 10/101,865

(22) Filed: Mar. 21, 2002

(65) Prior Publication Data

US 2002/0197940 A1 Dec. 26, 2002

(30) Foreign Application Priority Data

Jun. 20, 2001 (IT) ..... MI2001A1295

(51) Int. Cl.[7] ..... B24B 33/00

(52) U.S. Cl. ..... 451/344; 451/359; 451/526; 451/527; 451/530; 451/533; 451/539

(58) Field of Search ..... 451/344, 359, 451/526, 527, 530, 533, 539

(56) References Cited

U.S. PATENT DOCUMENTS 2,804,733 A * 9/1957 Hurst ..... 451/529
3,166,876 A * 1/1965 Manchester ..... 451/507
5,405,286 A * 4/1995 Welsch ..... 451/527

* cited by examiner

*Primary Examiner*—Joseph J. Hail, III
*Assistant Examiner*—Shantese McDonald
(74) *Attorney, Agent, or Firm*—Pearne & Gordon LLP

(57) ABSTRACT

Abrasive body (1) capable of being used in surface processing devices that has an active face (2*a*) provided with appropriate means of abrasion (3) intended to perform finishing operations on the surface of an object when the said body is set in motion. The abrasive body has a predetermined number of substantially passing cuts (6) defined by the respective flaps (7, 8) lying side by side. When the abrasive body is set in motion on an object to be processed, flaps (7, 8) deform in such a manner as to create appropriate opening that will permit the abraded dust particles to be removed solely and exclusively from that part of the abrasive body actually in contact with the object (FIG. 2).

27 Claims, 9 Drawing Sheets

7
6
8
2a
6
A
6
6
6
8
7
8
7
3
1

4
9
7
8
2a
7
8
4
9
9
4
6
6
6
7
8
3
1
4
9

SURFACE PROCESSING ABRASIVE BODY, SUPPORT PROVIDED WITH SAID BODY AND MACHINE COMPRISING THE PROCESSING ABRASIVE BODY AND SUPPORT

BACKGROUND OF THE INVENTION

1. Field of the Invention

The present invention concerns an abrasive body intended for surface processing, a support for the abrasive body and a machine comprising said abrasive body and support.

2. Description of the Related Art

It is well known that for many years past there have existed in the market numerous surface-processing devices that by means of the movement of some abrasive body are capable of finishing the surfaces of a wide range of objects, including furniture, wooden articles or rubber, plastic or metal parts of, for example, automobiles or other articles.

In particular, the processing that these devices are intended to carry out are substantially surface-finishing operations (grinding adjustments, smoothing, polishing, removal of working residues, etc.) and operations to prepare the surfaces for such further processing as painting, gluing and the like.

In particular, the machines known today essentially consist of a frame to which the user can attach a supporting element intended to receive the abrasive body and to be set in rapid motion to enable it to carry out the processing operation.

In other words, such surface processing machines will be equipped with a means for producing movement, typically an electric or pneumatic motor, that will apply the motion it generates to the support and therefore also to the abrasive body via an appropriate transmission shaft.

The device may also be provided with appropriate gripping elements by means of which the user may hold and guide it while carrying out the processing operations on the object to be processed.

When the machine is switched on, the support and the abrasive body are set in motion and the operator can carry out the necessary operations by bringing the abrasive body into contact with the surface to be finished.

A first problem associated with the machines briefly described above is bound up with the fact that—by their very nature—operations of processing surfaces by means of abrasion inevitably imply the creation of dust particles as a result of the material that is removed during the operation.

With a view to obviating this difficulty, the machines of this type produced and marketed in the more recent past have often been provided with appropriate suction systems that generate a depression in the area of the support and the abrasive body, so that the abraded particles can be sucked up from the working zone and led away via appropriate channels or ducts in the support.

In particular, the said suction is generally made possible because both the support associated with the machine frame and the abrasive body are provided with appropriate suction holes.

According to the type of material that is to be processed, as also the suction force and the type of machine involved, the number and the layout of these holes can vary very considerably.

It should however be noted that these devices (i.e. machine-support-abrasive body systems), even though they are widely available in the market, are associated with a number of drawbacks and/or operating limitations.

First of all, it should be noted that the typical surface that has to be processed will not be perfectly flat and/or that the processing may have to be carried out at the edges or corners of the surface or on surfaces on which it is not possible to rest the whole of the abrasive body.

In such situations it is readily obvious that only some of the holes in the abrasive body will effectively come to be placed in the processing zone; the remaining suction holes, on the other hand, will be situated away from the processing surface and also from the dust generated by the processing. Consequently, the suction force will inevitably and disadvantageously be greater where there is no resistance to the passage of the air, that is to say, at the holes situated away from the processing zone.

Fundamentally this implies that the suction of the material will occur at the holes situated away from the processing surface and therefore also away from the zones where the abraded dust particles are to be found.

The limit just explained can obviously prove harmful to the health of the operator, since he will be working in an environment that has not been cleansed of the dust material generated during the processing; it can lead to cleaning problems in the work area and may also imply problems bound up with the fact that the abraded particles will remain on the surface that has to be processed, where they will cause obstruction and thus reduce the efficiency of the processing.

Furthermore, the very presence of these suction holes appreciably diminishes the active surface of the abrasive body available for removing material from the surface, thus inevitably reducing the work output that can be obtained from it as compared with a similar body devoid of such holes.

Lastly, the presence of holes only in some parts of the abrasive body may imply that some of the abraded particles are not sucked away and will therefore remain between the abrasive body and the surface to be processed, creating a layer of abraded material in the truest sense of the term and therefore an obstruction for the abrasive body that will reduce the latter's efficiency.

Lastly again, the holes in the abrasive body and in the support require to be exactly superimposed in order to cause complete dust suction and avoid abrasive body gumming.

SUMMARY OF THE INVENTION

In such situations it is the principal scope of the present invention to substantially obviate the drawbacks that have just been described.

The scope of the present invention is therefore to make available an abrasive body, together with a support that utilizes the said abrasive body and/or to which the said abrasive body can be applied, capable of providing a targeted suction and therefore assuring a very substantial increase of the efficiency of the abrasive body and/or the abrasive body-support combination and/or the machine-abrasive body-support combination. A further scope of the invention is to attain the aforementioned objectives without complicating the structure of the machine-support combination and without necessarily having to increase the suction power and therefore also the energy consumption and the costs associated therewith.

Another scope of the invention is that of making available an abrasive body that is simple to produce, implies substantially limited costs and, while yet improving the efficiency, does not have any of the operating drawbacks associated with the abrasive bodies marketed today.

These scopes, as well as others that will become more apparent in the course of the present description, are substantially attained by an abrasive body capable of being associated with surface processing machines and with the support for the abrasive body with which such machines are provided, all as described in the claims that follow the present description.

Further characteristics and advantages of the invention will become more readily apparent from the detailed description of a preferred but not exclusive form of an abrasive body in accordance with the present invention.

BRIEF DESCRIPTION OF THE DRAWING

The said description will be given hereinbelow, making reference to the attached drawings, which are furnished solely by way of example and are not to be considered limitative in any manner or wise, where.

In the figures set out above the reference number 1 is used to indicate the whole of an abrasive body in accordance with the present invention.

DESCRIPTION OF THE PREFERRED EMBODIMENT

Making reference to FIG. 1, a brief description will now be given of a surface processing machine 5 to which the abrasive body 1 may be attached, but this description will be kept very brief (since the machine is of a known type).

Typically such a machine 5 is designed to receive as a rigid attachment a support 10 that can be moved by means of appropriate motion generators, the machine being also capable of generating suction with the help of appropriate suction means that are in common use today.

Figure 1:
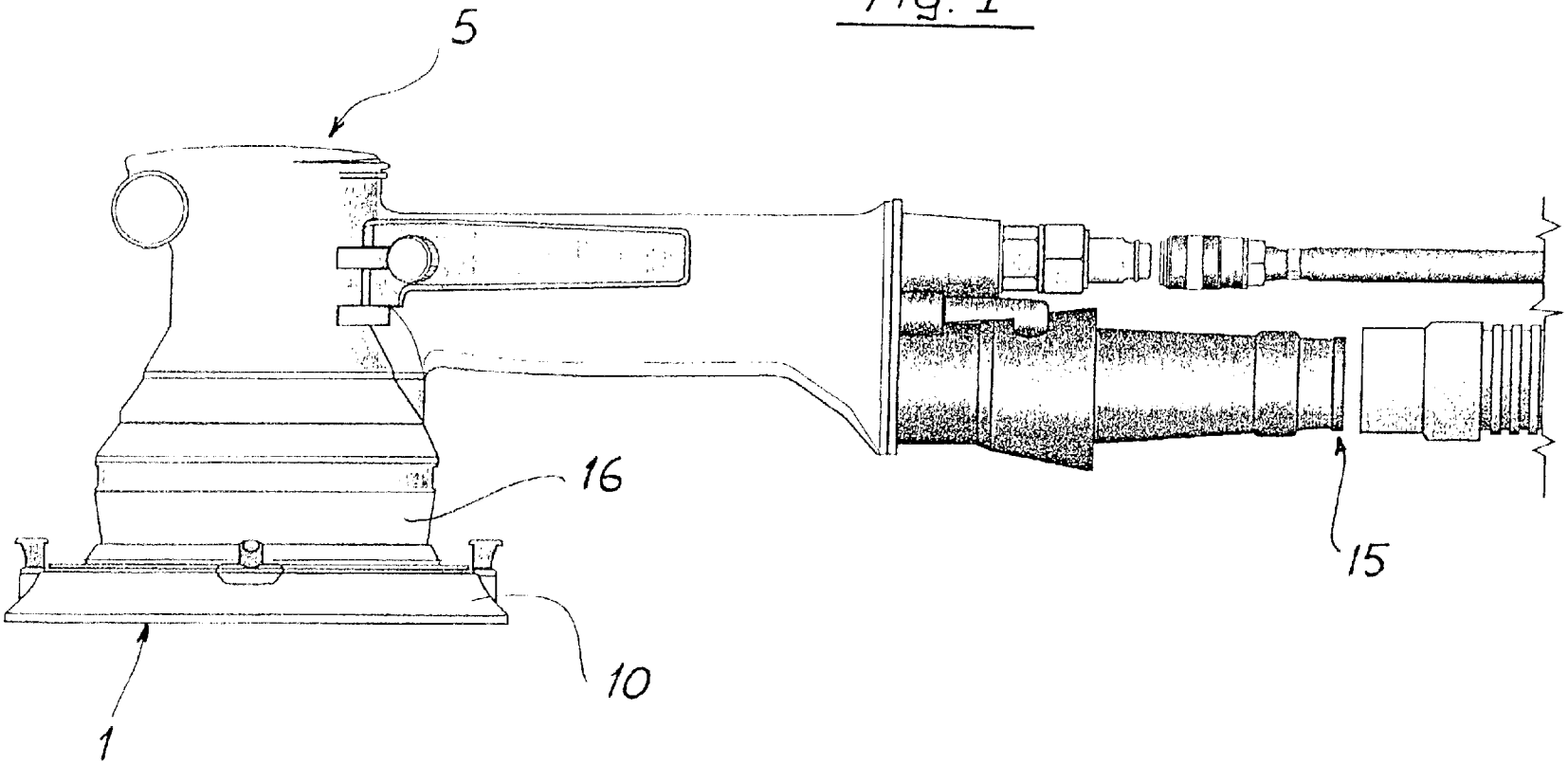
FIG. 1 is a view of a machine of the known type to which an abrasive body in accordance with the present invention can be attached.

It is clear that the implementation form of the suction means 15 may differ according to whether it is decided to use an appropriate suction pump or, as in the implementation example shown in FIG. 1, it is decided to use a self-sucking machine to create a depression into chamber 16 above the support 10 to which the abrasive body 1 is attached.

Obviously, we shall not here go into the implementation details of the two construction forms briefly outlined above, because they are both of a known type and are widely marketed and used.

If we now pass on to examining FIGS. 2 to 5, we may note that the abrasive body that is the object of the invention has an active face 2*a* that, in operating conditions, is intended to be turned towards the surface to be processed.

In particular, the said active face is provided with appropriate abrasive means 3 (FIG. 2*a*) that are intended to assure the actual surface processing when the abrasive body is set in motion.

The abrasive body 1 may or may not be provided with appropriate connecting means 4, 4A (see FIGS. 4, 5, 6 7) that make it possible for the said abrasive body to be attached to the support.

In this connection it should be underscored that the abrasive body 1 in accordance with the invention may be used either on its own in a manual manner, or mounted in either a fixed or a detachable manner on the support 10 and again used in a manual manner, or, thirdly, mounted on a support 10 that, in its turn, is attached to the machine 5 and can therefore be set in motion by the motorial means forming part of the said machine.

It is obvious that the connecting means 4A (for attaching the abrasive body to the support 10) can assume a very wide variety of forms, always provided that they make it possible for the abrasive body 1 to be firmly attached to the support 10 (see FIGS. 6 and 7, for example) in such a manner that any movement of the support 10 will have as its counterpart an identical movement of the abrasive body 1.

Figure 6:
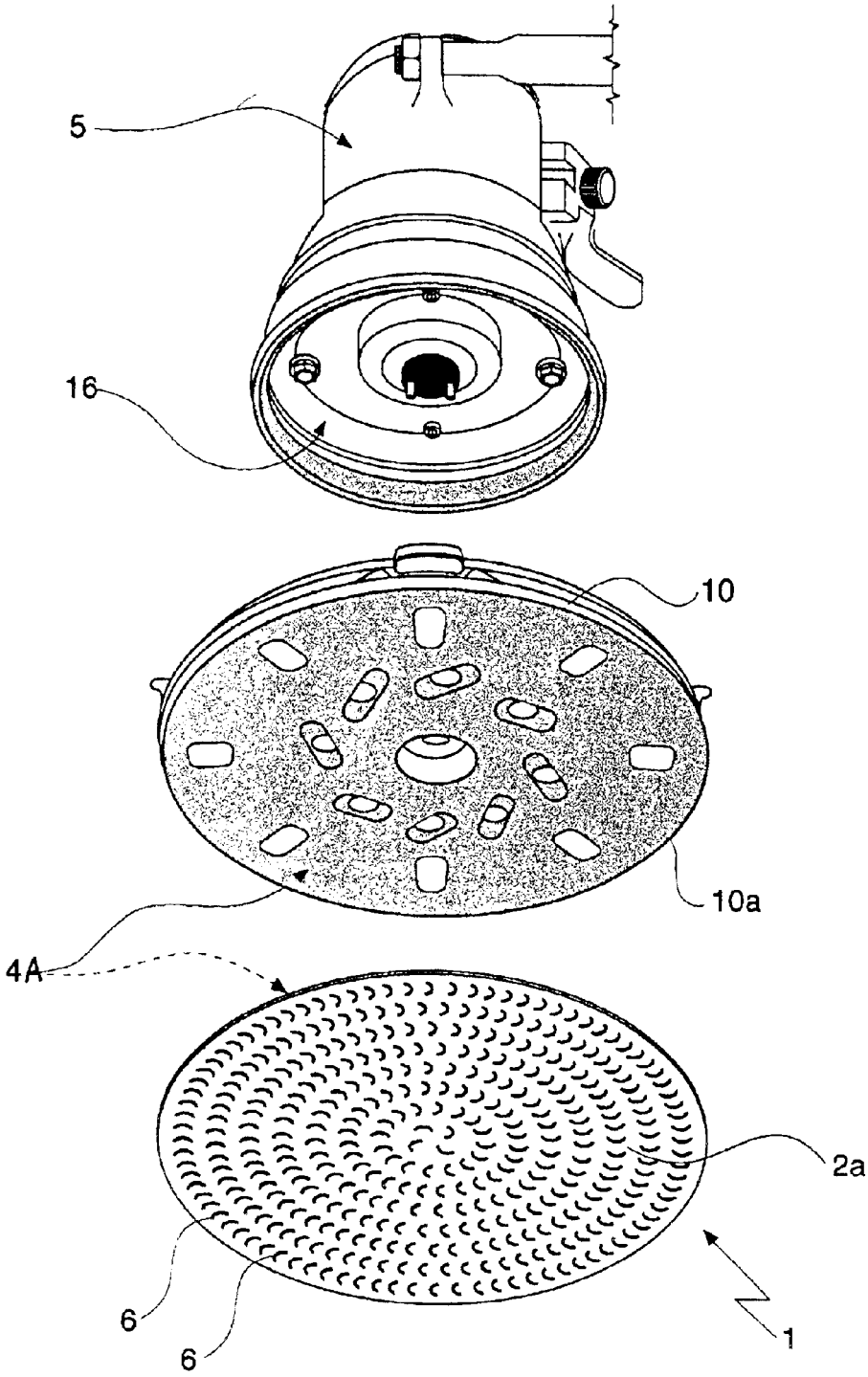
FIG. 6 is a diagrammatic view in exploded form of an implementation version of a machine-support-abrasive body combination in accordance with the present invention.
Figure 7:
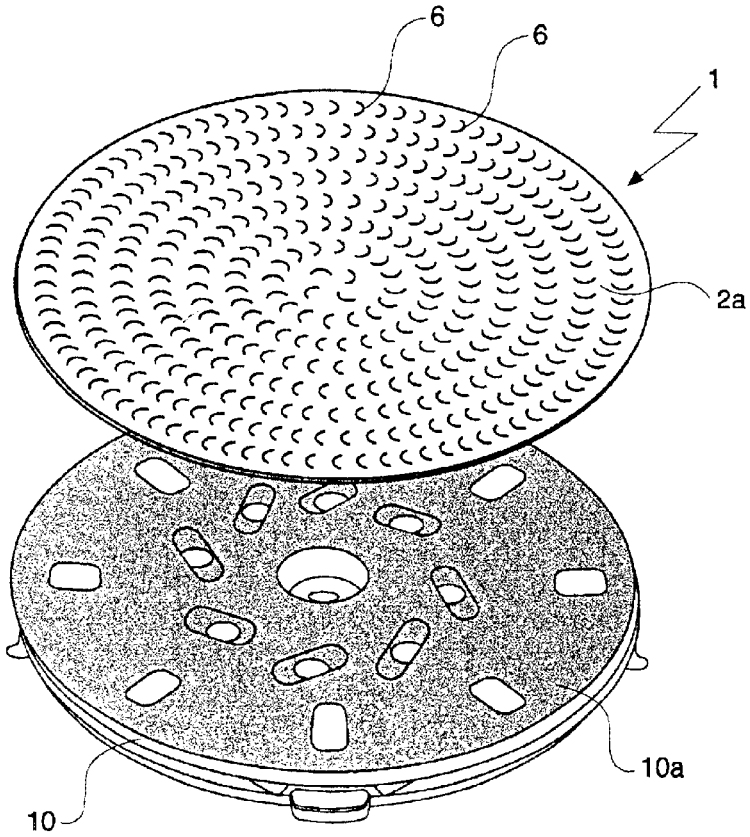
FIG. 7 illustrates possible means of connecting the abrasive body to a support and FIG. 7A illustrates a variant of the means of connection shown in FIG. 7.
Figure 7:
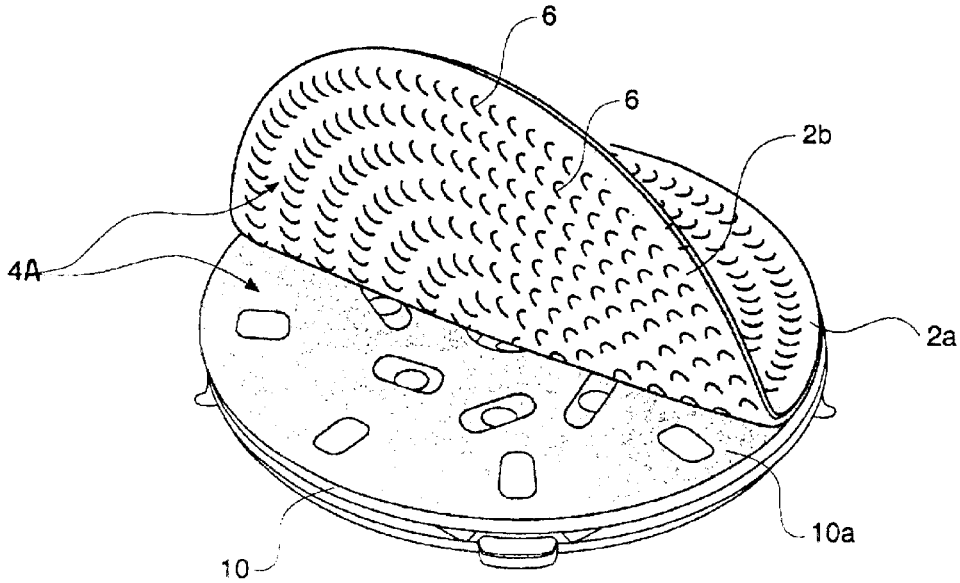
Figure 7A:
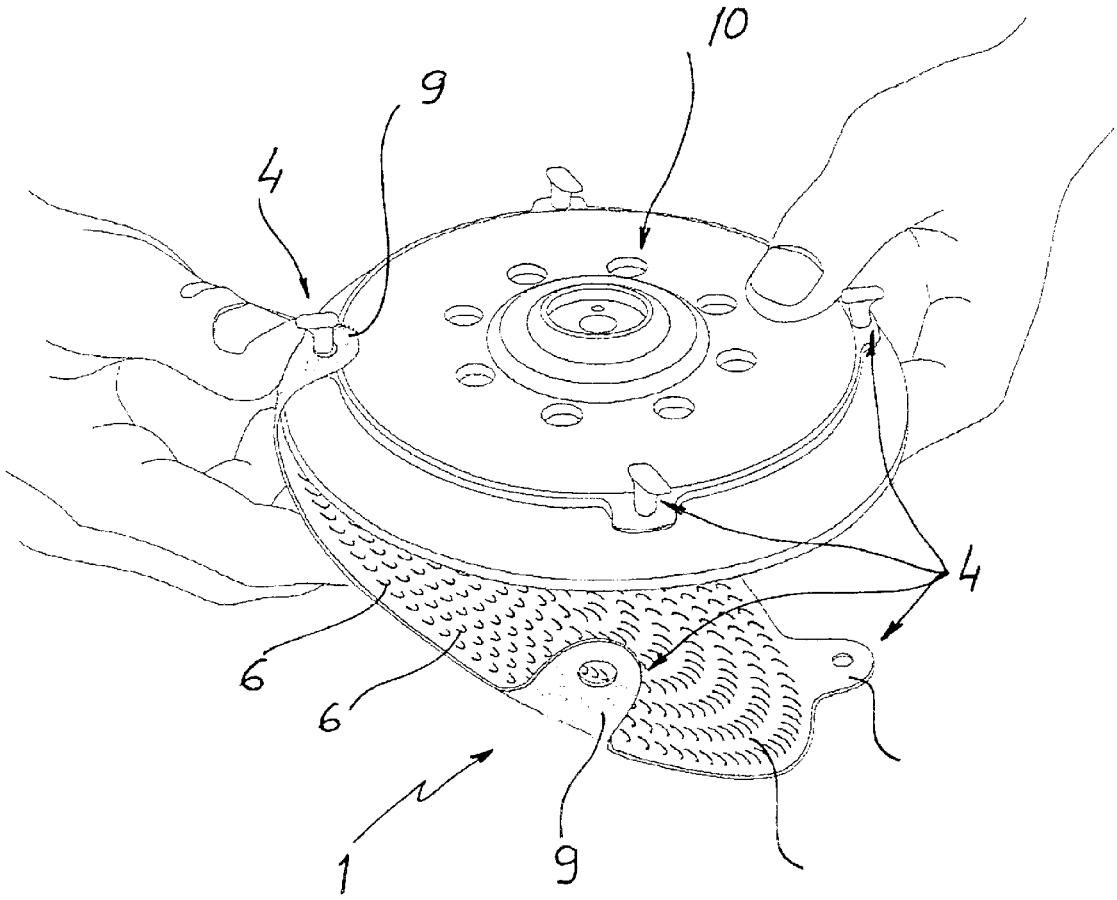

Known examples of connecting means are strap-type or self-adhesive attachments 4A as shown in FIGS. 6, 7 and are mechanical-type attachments 4 as shown in FIG. 7A.

In other words, with reference to FIG. 7, the support 10 has an operating surface 10*a* turned towards the abrasive body 1 (and also towards the surface to be processed) and is provided with an appropriate lining to enable it to become engaged with the corresponding engagement face 2*b* of the abrasive body 1.

Figure 4:
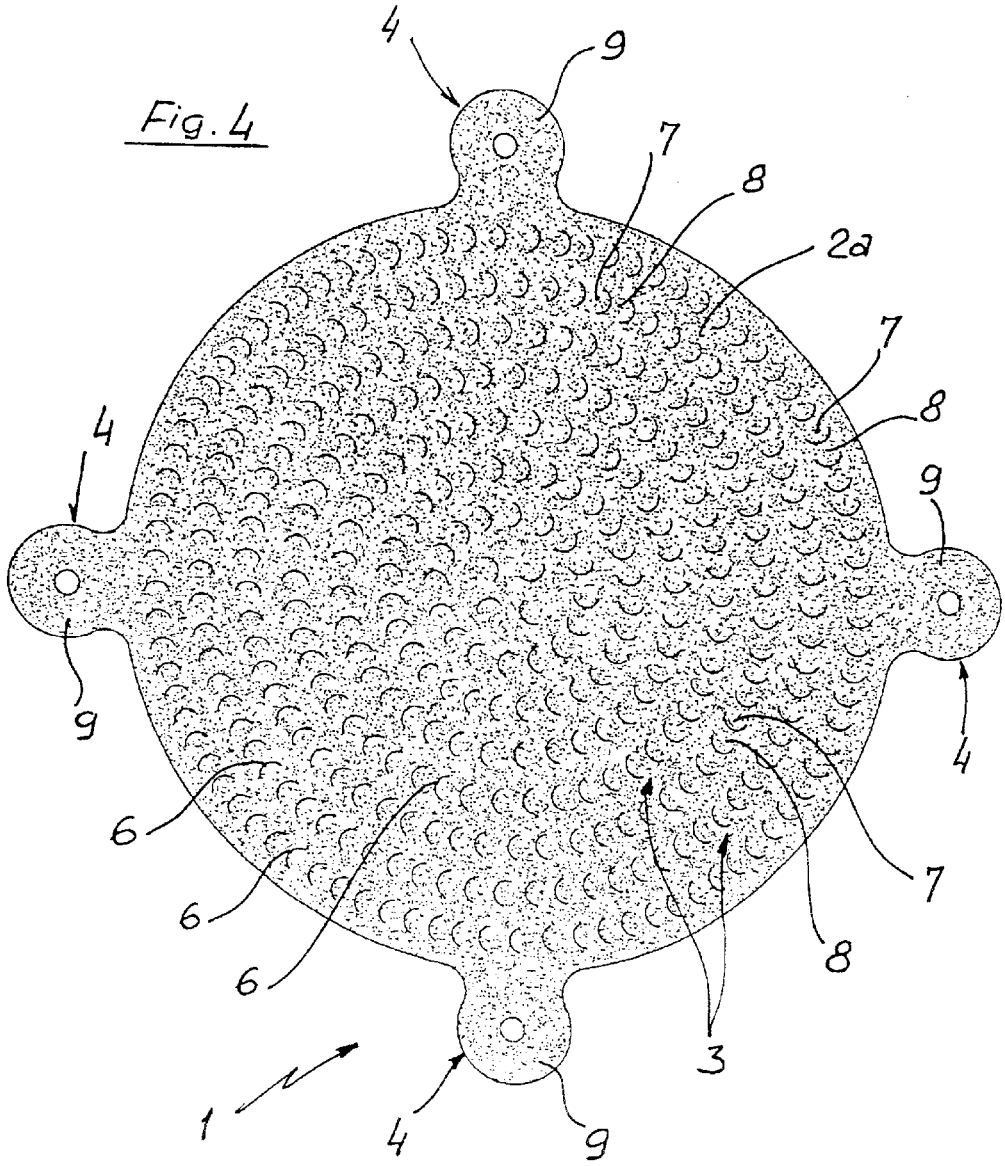
FIG. 4 is a view of the abrasive surface of the abrasive body of an implementation variant of the abrasive body shown in FIGS. 2 and 3.
Figure 5:
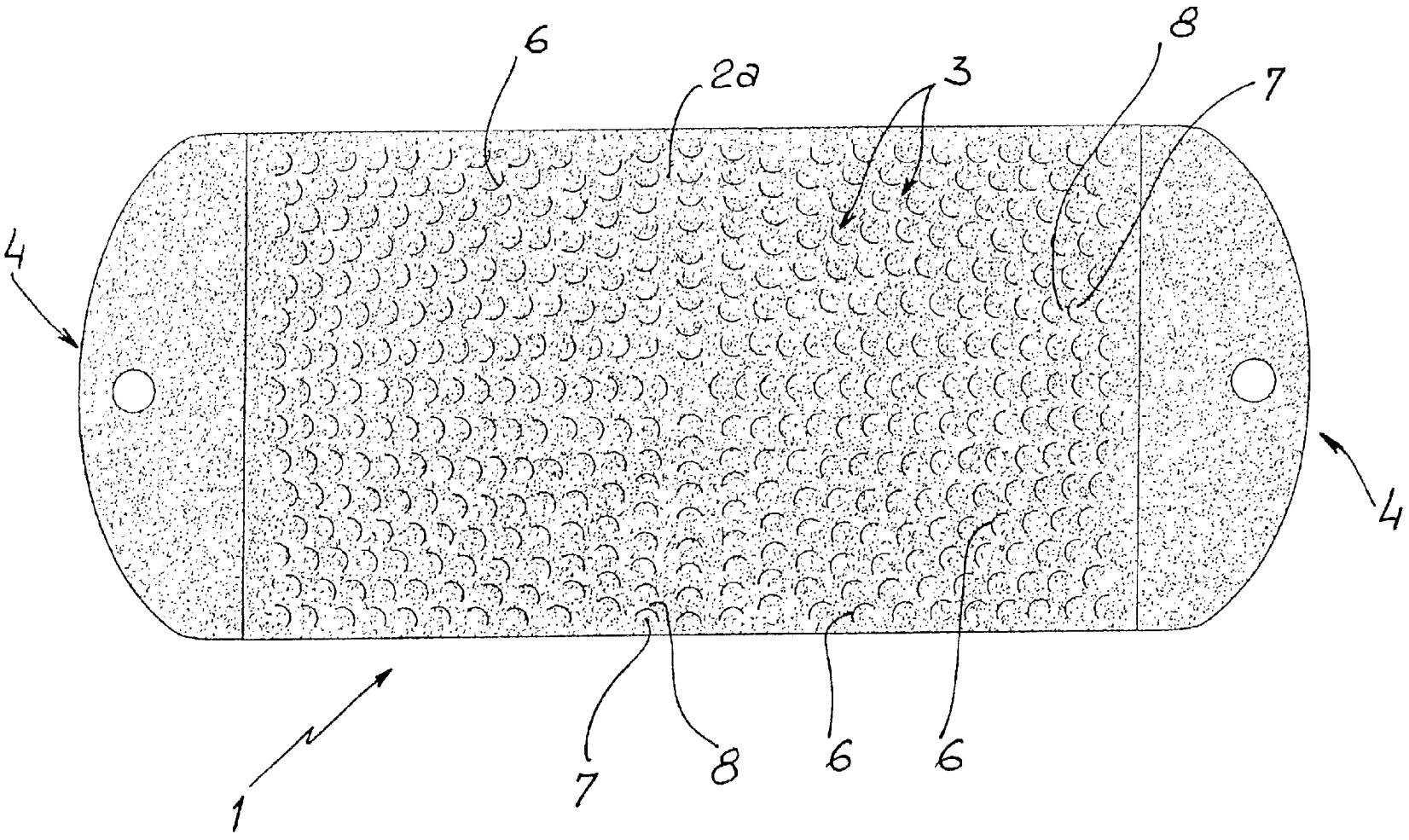
FIG. 5 is a further implementation variant of the abrasive body in accordance with the present invention.

A further implementation form is illustrated in FIG. 4, where the connecting means 4 consist of a predetermined number of engagement tabs (fins, tongues, winglets) intended to be connected to the support 10 (see FIG. 7A).

In particular, on the abrasive body there are four perforated tabs 9 intended to engage with the corresponding attachment elements on the support 10.

It is further clear that any other connecting means could be provided to assure that the support 10 and the abrasive body 1 will move substantially in unison.

Considering the construction details of the abrasive body, one may note that it is provided with a predetermined number of substantially passing cuts 6 defined by the respective flaps 7, 8 lying side by side.

It should also be noted that the abrasive body, possibly of a laminar conformation, namely very thin, is made of flexible material.

It will be advantageous if the operating surface 10*a* of the support 10 is likewise at least partially deformable, so that the abrasive body 1 and the operating surface 10*a* of the support can become deflected and deformed under the pressure acting on the active face 2*a* of the abrasive body 1.

In particular, a first inventive concept underlying the present invention is that of avoiding the formation of holes, possibly but not necessarily circular in shape, through which suction can be generated during the operating phases of the combination constituted by the support and the abrasive body.

The support 10 may be of compact material integral or not with the abrasive body 1 and is provided with holes for allowing passage of the abraded particles entered from the cuts 6 of the abrasive body.

In other words, the abrasive body 1 is devoid of passing cavities other than the aforesaid cuts, which are closed when the abrasive body is in a plane condition, thus assuring optimal functioning of the combination constituted by the support and the abrasive body, as will be explained in greater detail further on.

As may be seen from the drawings attached hereto, the cuts 6 may have different shapes; for example, the cuts may be curved in shape (FIGS. 2 and 2*a*), and could also be substantially triangular or rectangular (FIG. 3) or of other geometrical shapes, always provided that the two flaps that define the cut should be lying appropriately side by side, thus assuring that the abrasive body is free of openings.

Given the illustrated realization shapes of the cuts 6, these cuts are therefore defined by the two flaps lying side by side and forming part of one and the same abrasive body 1, where the first flap 7 is convex, while the second flap 8 is concave.

The cuts 6 may be distributed in the entire surface or only in a part of it, and their arrangement could be either regular or irregular.

Furthermore, the said cuts 6 could be oriented either in the same direction or in different directions.

Figure 2:
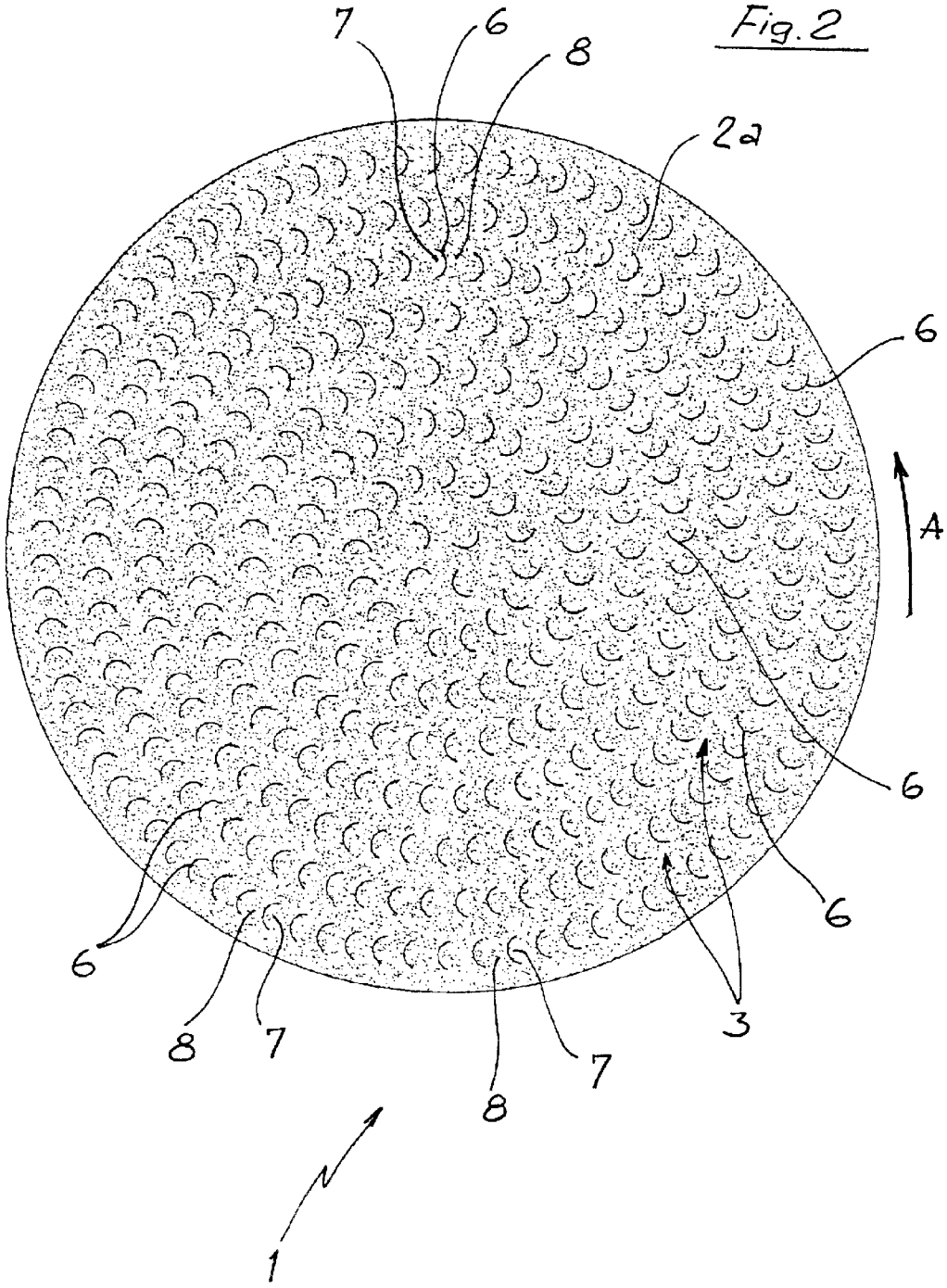
FIG. 2 is a view of the abrasive surface of an abrasive body in accordance with the present invention.
Figure 2A:
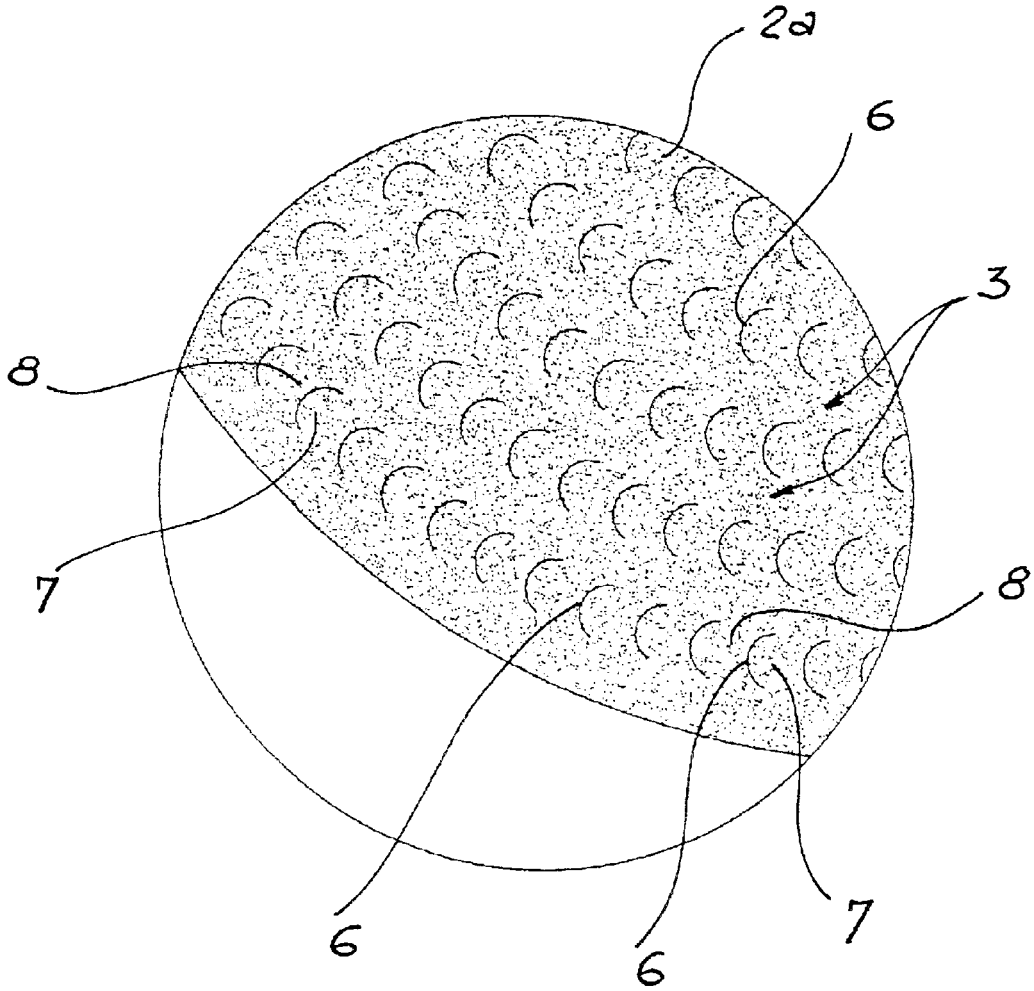
FIG. 2*a* is an enlarged detail of the abrasive body shown in FIG. 2.
Figure 3:
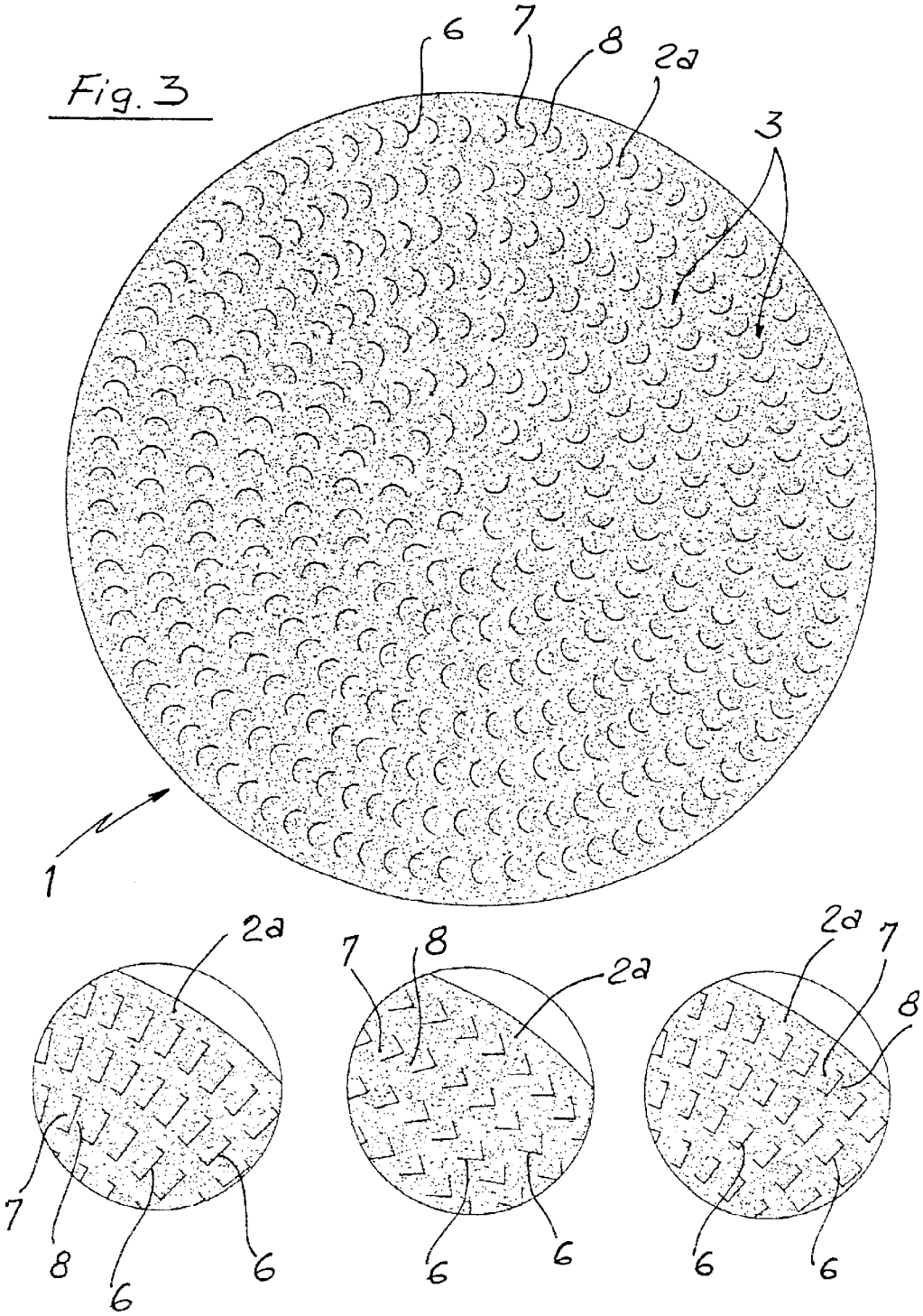
FIG. 3 is a view of the abrasive surface of the abrasive body shown in FIG. 2 in which there are indicated some possible outlines of the cuts.

But the reason why all the cuts have preferably the orientation with respect to the rotation direction A as shown in FIG. 2 is to avoid that the flaps 7 open because of a hit of their edges against a projection encountered on the piece under processing.

In this manner the topology of the cut is such as to maintain the cuts stably in their closed condition.

Having made clear the above, we can now pass on to describing the functioning of the abrasive body 1 in greater detail, specifying also the advantages that can be gained by its use.

Once the abrasive body 1 has been placed on the support 10 and the latter has been attached to the machine, setting into motion also the suction that is to act on the support 10, the particular conformation of the abrasive body 1 is such that the flaps 7, 8 defining the cuts 6 come to lie side by side in the position in which the cuts are closed, thus considerably limiting the effects of the suction action.

The cuts that are situated in parts of the abrasive body not in contact with the processing surface will still be in their normal closed positioning in which the suction force cannot become effective.

In other words, the use of the abrasive body in accordance with the present invention ensures that only the cuts actually situated in the processing area will open by the pressure of the abraded particles that are eliminated subsequently by the suction action.

When the abrasive body is being used on surfaces that are not rectilinear, on edges and, quite generally, on objects where only parts of the abrasive body are actually in contact with the processing surface, two working conditions will typically be generated: in a first zone not in contact with the processing; where there are no forces acting on the abrasive body, the cuts are in their closed condition and the suction, not being able to act through the abrasive body, will therefore remain ineffective, in a second, the actual working area (i.e. where the abrasive body is in contact with the processing surface), the cuts opened by the pressure of the abraded particles will be in their open position, thus allowing the suction to become effective and to remove the dust and the abraded particles.

The invention produces some important advantages.

Firstly, it optimizes the dust-suction process without in any way creating constructional complications.

In other words the invention permits the opening of only those cuts actually situated in the working area and therefore in the area where it is desirable to have an effective suction force. At all other points, i.e. the parts of the abrasive body not in contact with the processing surface, these cuts remain in their closed position and do not permit the suction force to become effective.

Secondly, the abrasive body has an absolutely homogeneous structure and is not discontinuous as in the case of abrasive bodies of the known type, which are full of holes; this necessarily implies a greater abrasive surface and therefore a better performance. Furthermore, the opening of the cuts in the zones where the abrasive body is in contact with the processing surface prevents abraded particles from accumulating on the abrasive surface of the abrasive body under the effect of the suction and thus improves its efficiency.

Over and above this, it should be noted that the cost of realizing the abrasive bodies are not increased, nor does the operator have to take any special measures when he uses them.

The particular layout pattern of the cuts (though, obviously, only in the case of abrasive bodies intended to be used with a rotary motion) makes it possible to avoid any kind of problem due to hit or undesired opening of the two flaps, so that in actual practice the user will not experience any problems.

What is claimed is:

1. A surface processing abrasive body comprising an active face for processing an object and an attachment face which is connectable to an operating surface of a deformable support, said abrasive body being provided with a number of substantially passing cuts each defined by flaps lying side by side, the flaps lying side by side and constituting the cuts define a working condition of closure of the cuts when an operative portion of the abrasive body in which they are provided is not in contact with a surface that is to be processed and define a working condition of opening of the said cuts when the said operative portion of the abrasive body in which they are provided is in contact with the surface that is to be processed.

2. A surface processing abrasive body in accordance with claim 1 made of flexible material.

3. A surface processing abrasive body in accordance with claim 1 of a round shape.

4. A surface processing abrasive body in accordance with claim 1 of a rectangular or square shape.

5. A surface processing abrasive body in accordance with claim 1 provided with regularly distributed cuts on either the whole or a part of the surface of the abrasive body.

6. A surface processing abrasive body in accordance with claim 1 provided with irregularly distributed cuts on either the whole or a part of the surface of the abrasive body.

7. A surface processing abrasive body in accordance with claim 1 where the cuts are of a curved shape.

8. A surface processing abrasive body in accordance with claim 7, where the said cuts are all oriented in the same direction.

9. A surface processing abrasive body in accordance with claim 7, where said cuts are of irregular orientation.

10. A surface processing abrasive body in accordance with claim 1 where the cuts are of a triangular, square, or rectangular shape.

11. A surface processing abrasive body in accordance with claim 1 where each cut is defined by two flaps lying side by side, an internal flap and an external flap where the said internal and external flaps are defined by portions of material that are respectively convex and concave.

12. A surface processing abrasive body in accordance with claim 1, where the flaps permit the passage of abraded dust particles when they are in their opening condition.

13. A surface processing abrasive body in accordance with claim 1 provided with connecting means that permit it to be attached to a support.

14. A surface processing abrasive body in accordance with claim 13 where said connecting means are provided on the whole of the attachment face opposite to the active face to permit said abrasive body to be attached to a support.

15. A surface processing abrasive body in accordance with claim 13, where said connecting means are provided on a part of the attachment face opposite to the active face to permit the said abrasive body to be attached to a support.

16. A surface processing abrasive body in accordance with claim 13 where the said connecting means are substantially defined by a self-adhesive connection.

17. A surface processing abrasive body in accordance with claim 13, said connecting means consists of a predetermined number of tabs adapted to be attached to a support.

18. A surface processing abrasive body in accordance with claim 13 where the abrasive body and the connecting means are provided with common and corresponding cuts.

19. A surface processing abrasive body in accordance with claim 1 of a laminar conformation.

20. A surface processing abrasive body in accordance with claim 1 provided with means of abrasion on the active face adapted to perform an abrading action on the processing surface when the abrasive body is set in motion.

21. A support for a surface processing means integral with an abrasive body as claimed in claim 1.

22. A surface processing abrasive body comprising an active face for processing an object and an attachment face which is connectable to an operating surface of a deformable support, said abrasive body being provided with a number of substantially passing cuts each defined by flaps lying side by side and being provided with connecting means that permit it to be attached to a support, wherein said connecting means are substantially defined by a connection strap of hook and loop type.

23. A surface processing machine comprising at least one support, an abrasive body and a suction system to generate a depression over the said support and the abrasive body capable of sucking away abraded dust particles, the abrasive body comprising an active face for processing an object and an attachment face which is connectable to an operating surface of a deformable support which is associated with the suction system for abraded dust particles, said abrasive body being provided with a number of substantially passing cuts each defined by flaps lying side by side, the cuts being in communication with said suction system.

24. A surface processing machine according to claim 23 integral with the support which is integral with the abrasive body.

25. A surface processing machine in accordance with claim 23 where the abrasive body is provided with an attachment face that is turned towards and attached to an operating surface of the support.

26. A surface processing machine in accordance with claim 23, where the operating surface of the support and the said abrasive body are so deformable that the flaps in the abrasive body are opened by the abraded dust particles produced between the abrasive body and the object to be processed.

27. A surface processing machine in accordance with claim 26 where the deformation of the deformable support and abrasive body causes a selective opening of the cuts substantially in the zone of the abrasive body that is in contact with the object to be processed.

* * * * *